US006499599B1

(12) United States Patent
Hopkins et al.

(10) Patent No.: US 6,499,599 B1
(45) Date of Patent: Dec. 31, 2002

(54) EXPANDABLE PACKING END CAP

(75) Inventors: Timothy J. Hopkins, Midlothian, IL (US); Robert S. Biddinger, Arlington Heights, IL (US)

(73) Assignee: Tuscarora, Incorporated, New Brighton, PA (US)

( * ) Notice: Subject to any disclaimer, the term of this patent is extended or adjusted under 35 U.S.C. 154(b) by 0 days.

(21) Appl. No.: 09/713,123

(22) Filed: Nov. 14, 2000

(51) Int. Cl.[7] ..... B65D 81/02
(52) U.S. Cl. ..... 206/523; 206/588; 206/591
(58) Field of Search ..... 206/521, 523, 206/586, 588, 591, 594, 454

(56) References Cited

U.S. PATENT DOCUMENTS

| | | | | |
|---|---|---|---|---|
| 2,728,479 A | | 12/1955 | Wheeler | |
| 2,860,768 A | | 11/1958 | Smithers | |
| 2,905,315 A | | 9/1959 | Doll | |
| 3,531,040 A | * | 9/1970 | Myny | 206/523 |
| 3,580,469 A | | 5/1971 | Reese | |
| 3,695,421 A | * | 10/1972 | Wood | 206/523 |
| 3,854,650 A | | 12/1974 | Hanaue | |
| 3,938,661 A | | 2/1976 | Carmody | |
| 4,063,702 A | | 12/1977 | Wilde et al. | |
| 4,360,145 A | * | 11/1982 | Wilcox | 206/586 |
| 4,801,018 A | | 1/1989 | Wilde | |
| 4,840,277 A | | 6/1989 | Waldner | |
| 4,972,954 A | | 11/1990 | Dickie | |
| 5,769,233 A | | 6/1998 | Fredriks | |
| 6,082,543 A | * | 7/2000 | Beliveau | 206/523 |
| 6,092,651 A | | 7/2000 | Miller | |

FOREIGN PATENT DOCUMENTS

| | | | | |
|---|---|---|---|---|
| FR | 2 651 747 A1 | * | 3/1991 | 206/523 |

* cited by examiner

*Primary Examiner*—Mickey Yu
*Assistant Examiner*—Jila M. Mohandesi
(74) *Attorney, Agent, or Firm*—Seyfarth Shaw

(57) ABSTRACT

The packing end cap includes a collar defining an interior cavity into which an item to be packaged may extend. The collar is comprised of longitudinal leg members interconnected at opposite ends by lateral leg members. An expansion joint is integrated within each lateral and longitudinal leg member. A plurality of blocks can also be disposed within the interior cavity hinged across an interior edge of a lateral member. Each block can pivot about the interior edge, enabling it to be positionable in a first position substantially parallel to a plane defined by the collar, and a second position perpendicular to the plane.

15 Claims, 1 Drawing Sheet

EXPANDABLE PACKING END CAP

BACKGROUND

This application relates generally to packing cushions for use in protecting and positioning an item within a container during shipping or storage. More particularly, this application pertains to a packing end cap construction expandible to fit a variety of differently sized and shaped items.

Packing end caps or cushions have long been used to protect and position an item stored within a container. One type of cap is formed of a lightweight, highly shock-absorbent material, such as a suitable expanded or foamed plastic material. Such a cap may be in the form of a collar having recesses and/or abutments arranged to mateably receive an end of the associated item. Packing end caps are usually used in pairs, respectively fitted on opposite ends of an item. The end of an item is typically disposed within and is supported by the collar, which acts as a spacer between the ends of the item and the adjacent ends of the container.

The problem with current packing end cap designs is that they are often sized to fit only one particular item. As a result, a plurality of different packing end caps are typically needed to ship differently sized and shaped items. Also, many packing end cap constructions are bulky and require large amounts of storage space to store.

Consequently, significant improvement in packing end cap design can be achieved by providing a packing end cap which can adjust to fit a plurality of different items. Furthermore, significant improvement can also be achieved by providing a packing end cap which can be easily stacked without occupying excessive storage space.

SUMMARY

Therefore, it is a general object of the invention to provide an improved packing end cap construction which avoids the disadvantages of prior packing end cap designs, while affording additional structural and operating advantages.

An important feature of the invention is the provision of a packing end cap which is expandable to fit a variety of differently sized items.

Another important feature of the invention is the provision of a packing end cap which occupies minimal storage space and facilitates stacking when not in use.

Another feature of the invention is the provision of a packing end cap of the type set forth, which is of relatively simple and economical construction.

The invention consists of certain novel features and a combination of parts hereinafter fully described and illustrated in the accompanying drawings, it being understood that various changes in the details maybe made without departing from the spirit, or sacrificing any of the advantages of the present invention.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
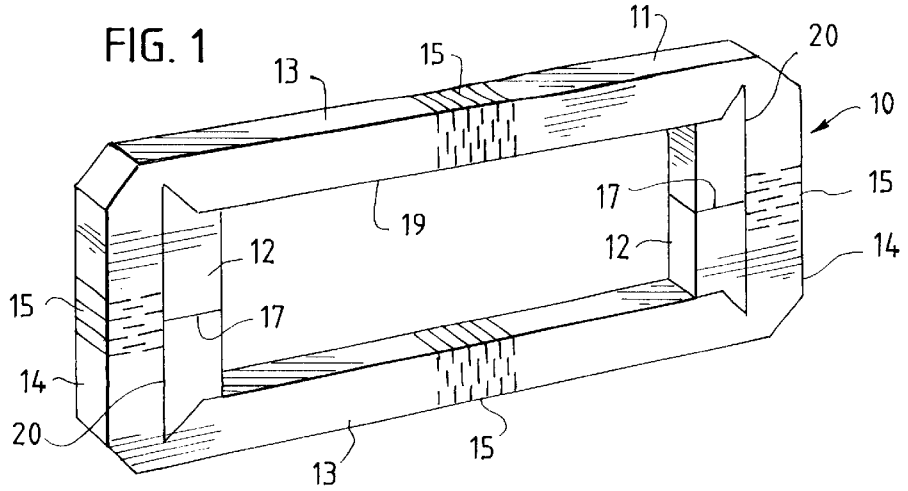
FIG. 1 is a perspective view of an embodiment of the subject invention in a non-use state.

Referring to FIG. 1, a preferred embodiment of the packing end cap 10 is disclosed. The packing end cap 10 includes a collar 11 defining an interior cavity 19 into which an item to be packaged may extend. The collar 11 is comprised of longitudinal leg members 13 and lateral leg members 14. The longitudinal leg members 13 are preferably interconnected to each other at opposite ends by the lateral leg members 14. Expansion joints 15, in the form of generally accordion-pleated sections, are preferably integrated within each longitudinal 13 and lateral 14 leg members.

Figure 2:
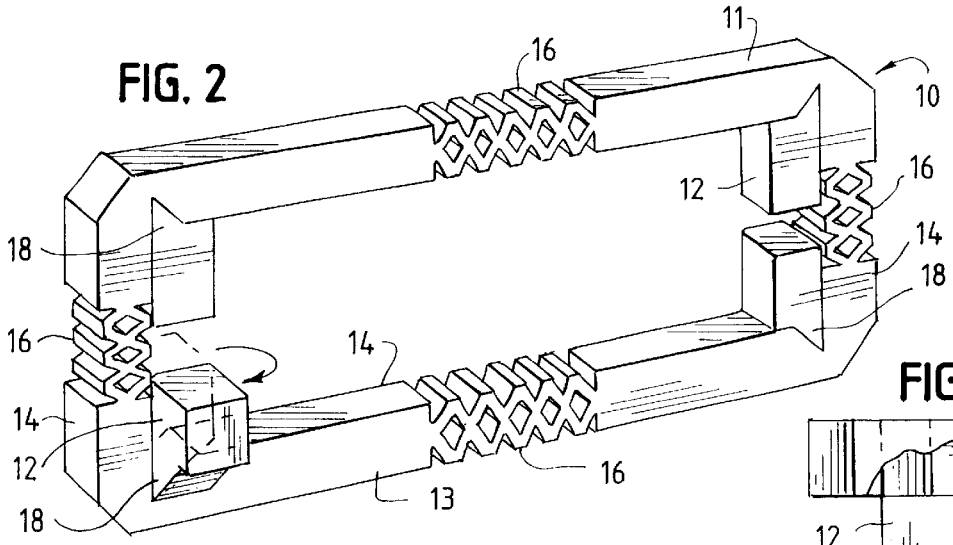
FIG. 2 is a similar view of the embodiment in FIG. 1 fully expanded and with one block pivoted to a position perpendicular to the collar.
Figure 3:
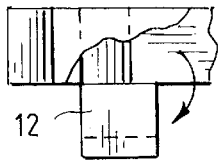
FIG. 3 is a fragmentary, bottom plan view in partial section of the pivoted block in FIG. 2.
Figure 4:
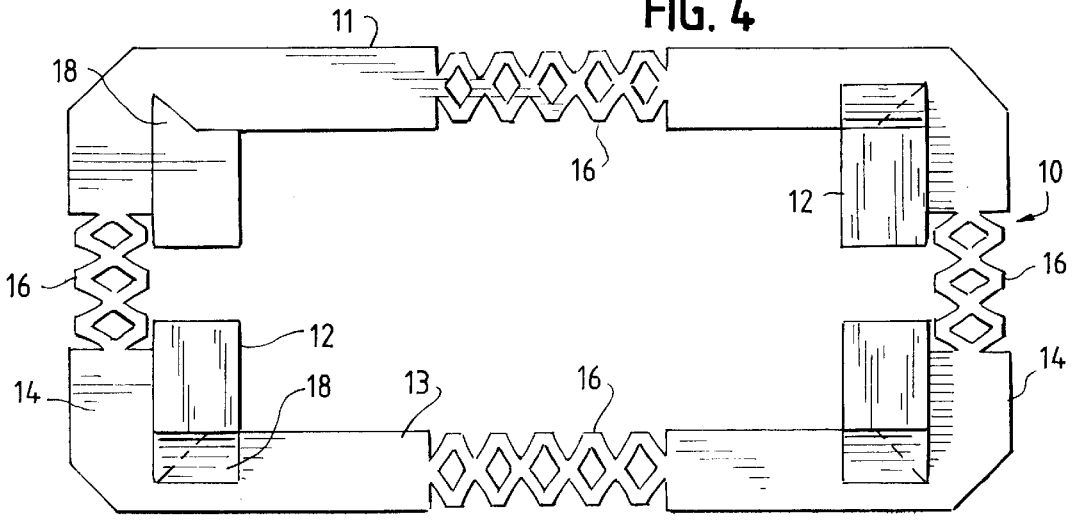
FIG. 4 is an overhead plan view of the embodiment in FIG. 1 fully expanded and with one block fully pivoted to a perpendicular position and one block partially pivoted to a perpendicular position.

Referring to FIGS. 2 and 4, in the preferred embodiment, the expansion joints 15 are defined by corrugations 16 which extend through both the longitudinal and lateral leg members. Since the expansion joints are aligned to different axes, the collar is also expandable along different, substantially mutually perpendicular axes. Alternate forms of expansion joints may be readily substituted. However, it is essential to the subject invention that the collar be expandible along different axes, so as to enable the end cap 10 to easily accommodate items of varying sizes and shapes.

Referring to FIGS. 1, 2, 3 and 4, a plurality of blocks 12 can also be disposed within the interior cavity 19, preferably hinged. As by a "living" hinge, across an interior edge 20 of a lateral member 14. The block can pivot about the interior edge 20, enabling it to be positionable between a first position, substantially parallel to a plane defined by the collar, and a second position, substantially perpendicular to the plane. In the first position, the space occupied by the end cap is minimized, reducing its required storage space and facilitating stacking of end caps when not in use. In the second position, the end cap extends out of the collar plane, enabling it to define abutment surfaces for engaging portions of the end of an item which project into the cavity 19.

Preferably, a wing 18 is located on each block 12. When the block 12 is in the second position, the wing 18 overlaps and engages the longitudinal member 13 and prevents the block 12 from pivoting back to the first position. In the disclosed arrangement, the block 12 also has a slit 17 cut therethrough, dividing it into two halves which separate when the lateral leg member is expanded.

The sizes of the blocks 12, their lines of attachment to the collar 11, and their shapes may vary, depending upon the particular application. Alternate arrangements can include smaller blocks, having blocks attached to the longitudinal leg members 13, having the blocks attached to an exterior edge of any leg member, and having blocks attached simultaneously to both lateral and longitudinal leg members. However, the block arrangement should not interfere with the expansion of the collar, and the block arrangement should be positionable between a first position substantially parallel to the collar and a second substantially perpendicular position.

The end cap 10 is preferably made of a resilient, vibration-damping and shock-absorbing material. The material should be lightweight as well. A form of expanded or foamed plastic will typically satisfy the characteristics required by an end cap 10, but other materials can be used to suit particular application requirements.

The matter set forth in the foregoing description and accompanying drawings is offered by way of illustration only and not as a limitation. While particular embodiments have been shown and described, it will be obvious to those skilled in the art that changes and modifications maybe made without departing from the broader aspects of applicants' contribution. The actual scope of the protection sought is intended to be defined in the following claims when viewed in their proper perspective based on the prior art.

What is claimed is:

1. A packing end cap construction comprising a collar and having plural expansion joints for expansion of the collar in different directions, and a block hinged to said collar and spanning an expansion joint and extending therebeyond and pivotable about an edge extending parallel to the direction of expansion of the spanned joint between a first position disposed within the collar, and a second position projecting outwardly of the collar, the block including a slit cut therethrough and being separable along the slit to accommodate expansion of the expansion joint.

2. The packing end cap construction of claim 1, wherein said packing end cap is formed of a resilient material.

3. The packing end cap construction of claim 1, wherein said collar is defined by a pair of longitudinal leg members, interconnected at opposite ends by lateral leg members, each of said lateral and longitudinal leg members having an expansion joint integrated therein.

4. The packing end cap construction of claim 3, wherein said expansion joints are defined by corrugated sections of said lateral and longitudinal leg members.

5. The packing end cap construction of claim 4, wherein the block is hinged to a lateral leg member.

6. The packing end cap construction of claim 3, wherein said block has a retaining wing engageable with an adjacent longitudinal member.

7. A packing end cap construction comprising a collar expandable in both lateral and longitudinal directions, and a block pivotally hinged to said collar, said collar defined by longitudinal leg members interconnected by lateral leg members, with each of said lateral and longitudinal leg members having an expansion joint integrated therein, the block spanning an expansion joint and extending therebeyond and pivotal about an edge extending parallel to the direction of expansion of the spanned joint and including a slit cut therethrough and being separable along the slit to accommodate expansion of the expansion joint.

8. The packing end cap construction of claim 7, wherein said expansion joint is defined by corrugated sections of said lateral and longitudinal leg members.

9. The packing end cap construction of claim 7, wherein said block is hinged across an interior edge of said lateral member.

10. The packing end cap construction of claim 7, wherein said block has a retaining wing engageable with an adjacent longitudinal leg member.

11. The packing end cap construction of claim 7, wherein said packing end cap is formed of a foamed plastic material.

12. A packing end cap construction comprising a collar expandable in both lateral and longitudinal directions, and a block hinged to said collar, said collar defined by lateral leg members interconnected by longitudinal leg members, each of said lateral and longitudinal leg members including an expansion joint defined by a corrugated section thereof, said block pivotally hinged to a lateral member for movement about an edge on the lateral member and spanning the expansion joint in the lateral member and extending therethrough and having a slit cut therethrough, the block being separable along the slit to accommodate expansion of said lateral leg member.

13. The packing end cap construction of claim 12, wherein said block has a retaining wing engageable with an adjacent lateral leg member.

14. The packing end cap construction of claim 12, wherein said packing end cap is formed of a foamed plastic material.

15. The packing end cap construction of claim 4, wherein the block is a first block, and further comprising a second block hinged to the collar opposite the first block and spanning a second expansion joint, the second block including a slit cut therethrough and being separable along the slit to accommodate expansion of the second expansion joint.

* * * * *